United States Patent [19]

Burns

[11] Patent Number: 5,022,112

[45] Date of Patent: Jun. 11, 1991

[54] PAINT BRUSH WITH MICROCELLULAR SYNTHETIC BRISTLES

[75] Inventor: Fredrick B. Burns, South Milwaukee, Wis.

[73] Assignee: Newell Operating Company, Freeport, Ill.

[21] Appl. No.: 177,610

[22] Filed: Apr. 5, 1988

Related U.S. Application Data

[62] Division of Ser. No. 80,948, Aug. 3, 1987, Pat. No. 4,937,141.

[51] Int. Cl.[5] ..... A46B 9/06

[52] U.S. Cl. ..... 15/159 A; 15/DIG. 6; 428/376; 428/364

[58] Field of Search ..... 15/159 A, DIG. 5, DIG. 6; 428/376, 398, 364, 395, 365, 400, 409

[56] References Cited

U.S. PATENT DOCUMENTS

| | | | |
|---|---|---|---|
| 3,118,161 | 1/1964 | Cramton | 15/159 |
| 3,220,960 | 11/1965 | Wichterle et al. . | |
| 3,344,457 | 10/1967 | Grobert | 15/159 |
| 3,957,936 | 5/1976 | Lauchenauer | 264/53 |
| 4,139,513 | 2/1979 | Tanaka et al. . | |
| 4,139,692 | 2/1979 | Tanaka et al. . | |
| 4,182,822 | 1/1980 | Chang . | |
| 4,192,827 | 3/1980 | Mueller et al. . | |
| 4,224,427 | 9/1980 | Mueller et al. . | |
| 4,328,148 | 5/1982 | Kuzma . | |
| 4,343,927 | 8/1982 | Chang . | |
| 4,388,428 | 6/1983 | Kuzma et al. . | |
| 4,388,436 | 6/1983 | Chen . | |
| 4,409,372 | 10/1983 | Ward et al. | 525/425 |
| 4,433,111 | 2/1984 | Tighe et al. . | |
| 4,486,577 | 12/1984 | Mueller et al. . | |
| 4,493,910 | 1/1985 | Tighe et al. . | |
| 4,605,712 | 8/1986 | Mueller et al. . | |
| 4,638,040 | 1/1987 | Hammar . | |
| 4,640,965 | 2/1987 | Falcetta et al. . | |
| 4,650,843 | 3/1987 | Yokoyama et al. . | |

*Primary Examiner*—P. C. Sluby

*Attorney, Agent, or Firm*—James G. Staples

[57] ABSTRACT

A brush with synthetic bristles which have the attributes of natural bristles including irregular surface texture for holding and applying paint. Brushes made in accordance with the invention are easy to clean while being resistant to abrasion and deterioration by water. The surface texture of the bristles also facilitates assembly of the bristles into a brush by the use of adhesive.

4 Claims, 2 Drawing Sheets

PAINT BRUSH WITH MICROCELLULAR SYNTHETIC BRISTLES

This invention relates to an improvement in brushes, an improvement in synthetic bristles used in rushes, and methodology for producing such improved synthetic bristles.

BACKGROUND OF INVENTION

It is useful to first discuss the improvements in synthetic bristles. In mankind's long history of utilizing natural materials, considerable application has been made of relatively coarse hairs, filaments and fibers of animal and vegetable origin. Bristle is a common term for these materials, although the term is often restricted to mean animal hair, and even more specifically, sometimes to the hair of the swine. In the context of this disclosure, I use the term bristle in its broadest sense to cover all naturally derived filamentatious material which can be used to make the flexible brushing portion of a brush. I further define a brush as a device, composed of a multiplicity of bristles in which the base material in at least a portion of the bristles is a synthesized polymer, co-polymer, alloy, or mixtures, e.g., nylon, polyester, polyolefin, Amalon, Esterlon. As will be recognized by those skilled in the art, Amalon is a mixture of polyolefin and nylon, and Esterlon is a mixture of polyester and nylon.

Since the development of the first truly synthetic bristle (nylon) as an adaptation of synthetic fiber technology after World War II, a number of other synthetic bristle adaptations have been developed and commercially employed. These synthetics have displaced natural bristles in some brush applications. However, natural bristles are still important materials in the brush industry because the synthetics developed to date have not been completely satisfactory substitutes. On the other hand, some of the synthetics provide certain superior properties to the natural bristles for some applications (e.g. improved water resistance and abrasion resistance).

One objective of this invention is to provide synthetic bristles which have not only the aforementioned benefits of such synthetics, but also many of the attributes of natural bristles never before available in synthetic versions.

A second objective of this invention is to provide a synthetic bristle superior to conventional synthetics in terms of polymeric material utilization efficiency.

A third objective is to provide a synthetic bristle which is opaque, or nearly opaque, to light without requiring pigmentation or by using significantly less pigmentation than conventional synthetics.

Natural bristle materials, whether of vegetable or animal origin, result from organic growth processes wherein elongated cellular formations build upon one another to form essentially rod-like structures of sufficient resilience and integrity to serve the functional needs required in brushes for painting, powdering, scrubbing, sweeping and the like. It is the cellular wall formation that provides structural character to these natural bristles along with the complex chemical makeup of the specific bristle. Some natural bristles are essentially tapered in that one end (the butt end) of the bristle is larger than the other (tip end). Still others are not tapered or have very little of this tendency. Natural bristles are always irregular in shape along their length, and have scale-like outer surfaces. Some of these are naturally split at the end, forming tiny fingers which are useful in brush performance.

Synthetic bristles heretofore available have none of the cellular structures, shape irregularities or scale-like surfaces. Rather, they have dense polymeric structure and are highly uniform in shape, with smooth surfaces. Synthetic bristles are available in tapered or untapered form, and in cross-sectional profiles of solid round, hollow round, ribbed, S shaped and other shapes dependent on extrusion technology. All synthetics to date require physical splitting of the ends (flagging) where this is deemed desirable in brushes.

SUMMARY OF THE INVENTION

My improved synthetic bristles are specifically designed with cellular structures, irregular longitudinal and cross sectional shapes, and scale-like surfaces. They are designed in both tapered and untapered form, and in all the extrusion shapes as other synthetics.

The result of this improvement is to provide synthetic bristles which combine the appearance and physical properties associated with natural bristles with chemical and physical properties associated with the polymeric materials used in their composition.

Furthermore, these improved synthetic bristles, by virtue of their cellular structure, are less dense than other synthetics made from the same polymers. For example, such bristles may possess only 70 to 75% of the weight of, (though not limited to this range), synthetics made in the same cross-sectional profile from the same base polymer. This benefit provides more efficient utilization of the base polymer and desirably lighter weight bristles. These improved synthetic bristles are more easily split or flagged than synthetics of the same cross-sectional profile.

My invention is illustrated more or less diagrammatically in the accompanying Figures wherein, FIG. 1 is a schematic view of a conventional mode of producing synthetic bristles;

DETAILED DESCRIPTION OF THE INVENTION

Figure 1:
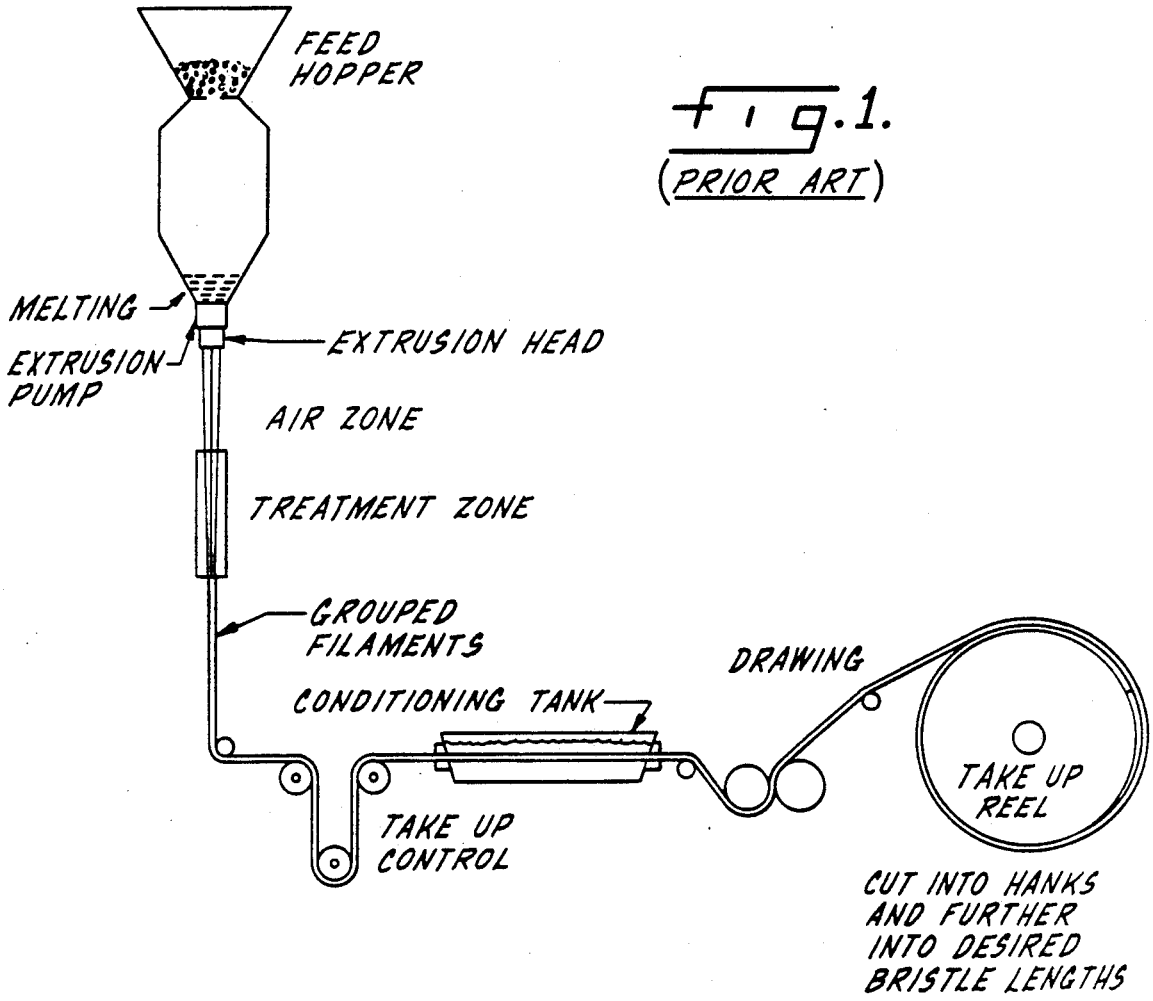
Fig. 1. (PRIOR ART)

To explain my improvements in brushes it is important to provide some basic brush design background. I have defined a brush as a device, composed of a multiplicity of bristles attached to a handle and designed primarily for painting, powdering, scrubbing, sweeping and the like. While any brush may perform all of these tasks outlined to some degree, use experience and refinement have led to more specific brush designs for each of these applications. For example, the shapes of the handles are generally different and may be expressly designed for these different functions of painting, powdering, sweeping and scrubbing, as well as refined within each function, especially as related to the specific task. Hence scrubbing brush handles usually take different forms from painting brush handles, but tooth scrubbing brushes usually also are different in design from floor scrubbing brushes, and brushes designed for sash painting normally have different shaped handles from wall painting brushes. Bristles used in brushes also are selected or designed for the particular application of the brush. In general, I define bristles as being relatively coarse hairs, filaments and fibers which possess sufficient resilience and integrity to provide the function required of a brush. Experience has shown that of these functions, scrubbing requires the most resilient bristles and painting the least resilient with artists brushes being the softest. Sweeping usually requires an intermediate resilience. Resilience is a function of the bristle's cross-sectional area relative to its length as well as the flexural properties of the bristle material substance.

It should also be recognized that different practical methods have evolved for attaching the bristles to the handles for these different functional brushes. Staple setting of bristle tufts is a commonly employed method for many designs of scrubbing and sweeping brushes. Strip binding is another method which is widely used. Twisted wire techniques are also used, especially when circular brushes are desired (such as bottle scrubbing brushes). The primary method used to make painting brushes is called ferrule setting wherein a bristle mixture is bound in a metal band with an adhesive setting material. The adhesive applied in liquid form penetrates within the interstices between the bristles, and if the bristle's cross-section is so designed, within the bristle itself.

With this background, my improvements in brushes are more easily understood. One such embodiment is improved paint brushes as explained below: Two paint brushes were constructed, using a standard formulation in one case, and an experimental formulation in the other. The difference was substitution in the experimental brush of 40% by weight of my improved cellular synthetic bristle for a like amount of a commercial synthetic bristle. Both synthetics were of tapered form; of polyester material; and of the same physical size. The two brushes were determined to have the same flexural stiffness when compared in a special device designed for that purpose.

Painting tests were then performed using a special machine which allowed both brushes to be compared in painting performance simultaneously using the same painting surface over a range of angles of address to the surface, and a range of displacements of the brush to the surface. The paint out results were compared in both the wet and dried states. It was clear to the three test observers that the experimental brush produced superior paint out results over the complete range of testing using Glidden Latex Spred Satin paint.

This experimental brush was also tested against a commercial brush formulated of natural animal bristle using Tru-Test Alkyd Semi-Gloss enamel (7174 color). The experimental brush provided clearly superior painting results. Still another test comparison was made to a commercial brush which contained approximately 50% natural bristle and 50% synthetic polyester bristle. This test also applied the Tru-Test Alkyd Semi-Gloss enamel and again the experimental brush produced superior painting results with the same number of painting strokes on the test machine.

Another test comparison was made to a commercial brush made from all polyester synthetic bristles. This brush was considered an outstanding performing brush. When both brushes simultaneously applied Dutch Boy latex 73-11 Semi-Gloss paint, the experimental brush was so superior that only three strokes were required to produce the quality of paint film that the commercial brush produced in four brush strokes.

I postulate that the superior results observed are derived from the use of my improved synthetic bristle because of its several unique properties previously described. Also, because the improved bristle uses less resin material than offset bristles, the resulting brushes are more economical to produce. Still another advantage is the superior holding character in the ferrule setting process when compared to other synthetics. This is a significant benefit since it reduces the probability of bristle shedding onto the painting surface. I attribute this benefit to the scale-like surface on the bristle which improves the attachment of the adhesive to the bristle.

I have previously described my improved synthetic bristles. The following disclosure describes the methodology I teach for producing said bristles. Synthetic bristles are conventionally produced by first melting an appropriate resin, thermoplastic polymer, co-polymer, alloy or mixture, in combination with certain additives to add opacity, color, and to minimize thermal degradation. Such materials are often pre-compounded in major constituents such as pelletized special grade resins, and pelletized colorants and additives. Standard practice is to melt the resin and additive mixture to a temperature appropriate to the resin grade for hot melt extrusion through a group of small diameter orifices in a head. A group of small diameter filaments emerge from the extrusion head and are carried forward through take up rolls, water baths (or other liquids) and controlled temperature zones, see FIG. 1. One function of this take-up system is to orient the essentially random molecular structure into an essentially axially aligned structure within each filament. This process, which elongates the filaments and reduces their diameters, is sometimes called drawing, and provides linear integrity to the filaments. These filaments are later cut to length. When the filament to length ratio is such that the resulting cut section has suitable resilience properties for use in a brush as a substitute for natural bristle as previously described, it is a synthetic bristle. By design of the orifices in the extrusion head, a variety of bristle cross-sectional shapes are commercially produced. For example, X shapes, triangular, round, and even hollow shapes are formed as taught by others. Special techniques have also been devised to extrude the melt at different linear rates of speed so that thicker and thinner sections are formed along the length of the filament. In this way sections may be cut so that tapered synthetic bristles are produced having a thick end and a thin end, and simulating in this respect naturally tapered bristle grown by hogs or swine.

Figure 2:
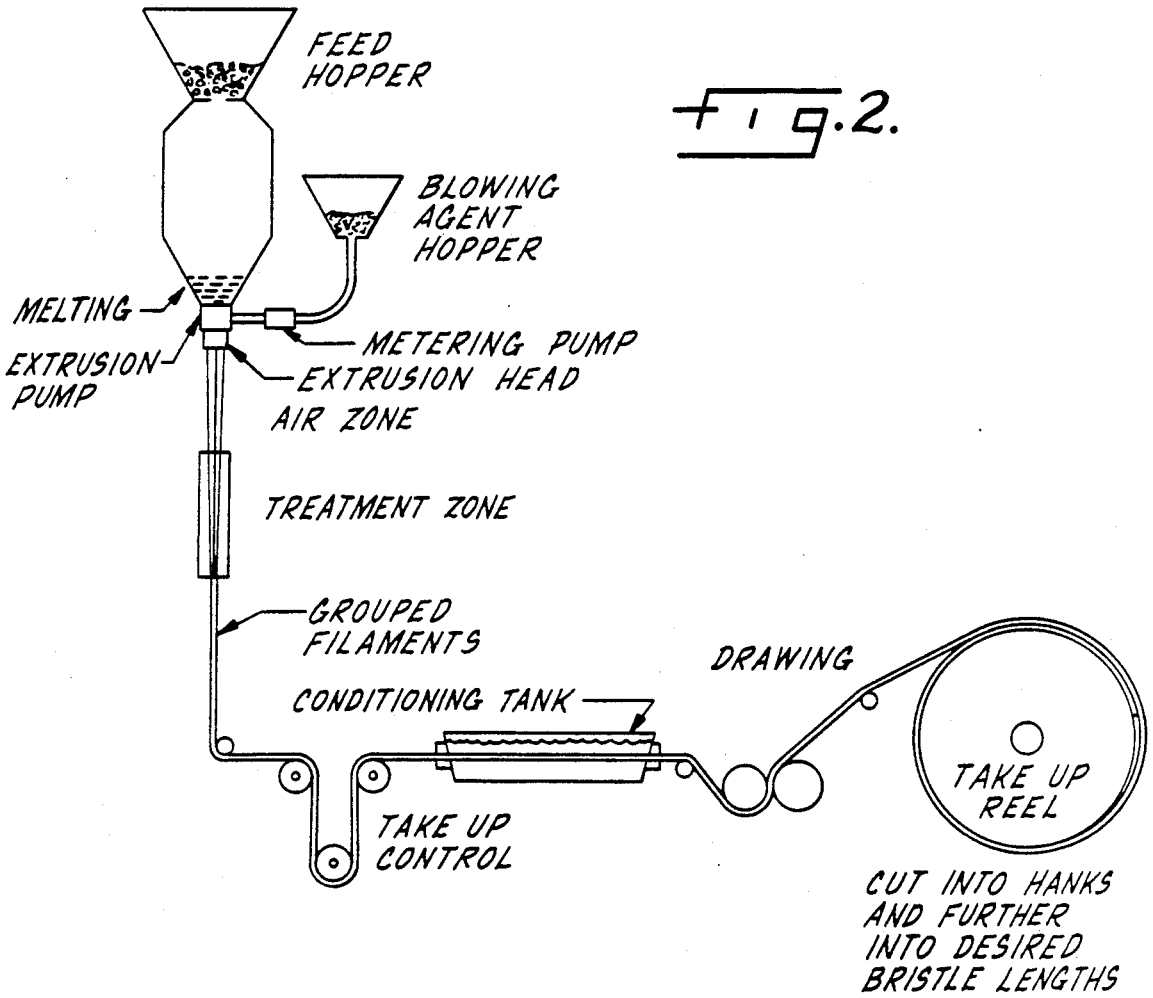
FIG. 2 is a schematic view of the new mode of producing synthetic bristles described herein.
Figure 3:
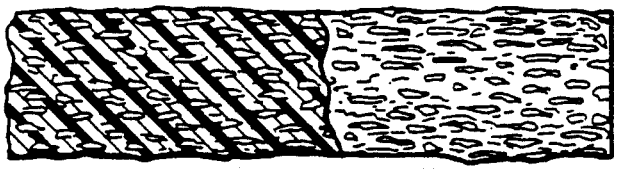
FIG. 3 is a side view, with a portion sectioned, of a solid bristle of the present invention.
Figure 4:
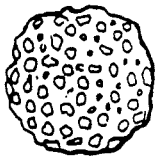
FIG. 4 is a right end view of the solid bristle of FIG. 3.
Figure 5:
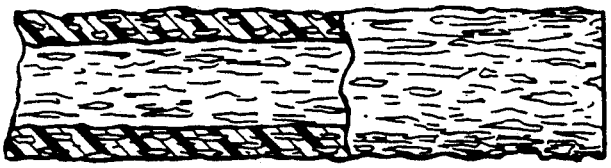
FIG. 5 is a side view, with a portion sectioned, of a hollow bristle of the present invention.
Figure 6:
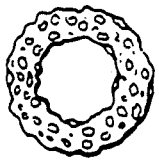
FIG. 6 is a right end view of the hollow bristle of FIG. 5.

My invention consists of including in the extrusion melt or process certain other additives, sometimes called foaming or blowing agents, including nucleating materials, which are designed to create tiny gaseous bubbles at random within the extruding filaments. It should be noted that the use of blowing agents in plastic parts manufactured by extrusion, injection and compression molding and other conventional plastic fabricating processes is well known as disclosed for example in the articles "Extruding Thermoplastic Foams", Modern Plastics Encyclopedia, Christopher Eaton, 1986–1987, pp. 243, 244 and "Foaming Agents", Modern Plastics Encyclopedia, Raymond Shute, Modern Plastics Encyclopedia, 1986–1987, pp. 150–154. See FIG. 2. As these filaments are drawn in the next stage of the process, tiny elongated cells are formed within the filament structure. See FIG. 3. The bubbles or bubble craters occurring near the filament surface(s) cause indentations and roughness at the filament surface which is scale-like in character, and which can be controlled in the extrusion portion of the process. Furthermore, the random occurrence and random size of the bubbles within the filaments form a somewhat irregular shape as opposed to the true, uniform shape resulting from conventional technology.

Although a preferred embodiment of my invention has been illustrated and described it will at once be apparent to those skilled in the art that modifications may be made within the spirit and scope of the invention. Accordingly, it is my intention that my invention not be confined to the foregoing exemplary description, but rather, solely by the scope of the hereinafter appended claims when interpreted in light of the relevant prior art.

I claim:

1. A brush, said brush comprising, firstly, a plurality of bristles, at least a portion of said bristles being homogeneous unitary synthetic brush bristles, said synthetic bristles being composed of a material selected from the group consisting of (a) a synthesized polymer, (b) a co-polymer, (c) an alloy, or mixture of synthetic polymers, said synthetic bristle having a wall structure of cellular configuration, said synthetic bristle having a non-uniform shape, and said synthetic bristle further having a scale-like surface finish, secondly, handle means, and thirdly, means for securing the plurality of bristles to the handle means.

2. The brush of claim 1 further characterized in that said portion of the bristles which is composed of the aforesaid homogeneous unitary synthetic bristles constitutes at least about 40 percent of the total number of bristles.

3. The brush of claim 2 further characterized in that said portion consists of from about 40 percent to 50 percent of the total number of bristles.

4. The brush of claim 1 further characterized in that the brush is a paint brush.

* * * * *